US011794311B2

(12) United States Patent
Junkins

(10) Patent No.: US 11,794,311 B2
(45) Date of Patent: Oct. 24, 2023

(54) VARIABLE ANGLE CLAMPING ASSEMBLY

(71) Applicant: Mitch Junkins, Newport Beach, CA (US)

(72) Inventor: Mitch Junkins, Newport Beach, CA (US)

( * ) Notice: Subject to any disclaimer, the term of this patent is extended or adjusted under 35 U.S.C. 154(b) by 131 days.

(21) Appl. No.: 17/407,715

(22) Filed: Aug. 20, 2021

(65) Prior Publication Data

US 2022/0080557 A1 Mar. 17, 2022

Related U.S. Application Data

(60) Provisional application No. 63/079,878, filed on Sep. 17, 2020.

(51) Int. Cl.
*B25B 5/00* (2006.01)
*B25B 5/14* (2006.01)

(52) U.S. Cl.
CPC ..... *B25B 5/14* (2013.01)

(58) Field of Classification Search
CPC .... B25B 5/00; B25B 5/04; B25B 5/06; B25B 5/14; B25B 5/101; B25B 5/125; B25B 5/067; B25B 5/082
See application file for complete search history.

(56) References Cited

U.S. PATENT DOCUMENTS 478,306 A * 7/1892 Bacon ..... E04D 15/025 33/649
5,020,233 A * 6/1991 Syken ..... B43L 7/12 33/456
5,318,284 A 6/1994 Demmeler et al.
5,494,553 A * 2/1996 Colucci ..... B25B 5/145 269/93
6,141,882 A * 11/2000 Syken ..... B43L 7/12 33/465
6,796,046 B1 * 9/2004 May ..... B43L 7/10 33/473
7,168,693 B1 * 1/2007 Sjuts ..... B25B 5/142 269/37
7,934,711 B2 * 5/2011 Wong ..... B25B 5/142 269/95
7,959,140 B2 * 6/2011 Wong ..... B25B 11/002 269/6
8,226,074 B1 7/2012 Hughey
(Continued)

*Primary Examiner* — Lee D Wilson
(74) *Attorney, Agent, or Firm* — Rutan & Tucker LLP; Hani Z. Sayed

(57) ABSTRACT

An apparatus and methods are provided for a variable angle clamp assembly. The variable angle clamp assembly comprises a first support arm that may be pivoted relative to a second support arm. A coupling mechanism enables fixating an angle between the first and second support arms. A clamp assembly is mounted onto an elongate opening disposed along each of the first and second support arms. Each clamp assembly includes a fixed jaw and a movable jaw that may be tightened by way of a threaded screw and a handle. The clamp assemblies are slidable and rotatable along the elongate openings. A lock stop enables the clamp assembly to be fixated relative to each of the first and second support arms. The clamping assemblies may be manipulated into a variety of angles and radial distances along the support arms to provide a variety of clamping solutions.

13 Claims, 2 Drawing Sheets

(56) References Cited

U.S. PATENT DOCUMENTS

| | | | | |
|---|---|---|---|---|
| 9,079,636 | B1 | 7/2015 | Arnall | |
| 9,861,217 | B1 * | 1/2018 | Ingels | A47G 1/18 |
| 10,682,742 | B2 | 6/2020 | Gudjonsson | |
| 2005/0098932 | A1 | 5/2005 | Panosian | |
| 2007/0221292 | A1 * | 9/2007 | Krohmer | B25H 7/00<br>144/286.5 |
| 2010/0237551 | A1 | 9/2010 | Swasbrook | |
| 2012/0228815 | A1 * | 9/2012 | Gurule | B25B 5/003<br>29/559 |

* cited by examiner

VARIABLE ANGLE CLAMPING ASSEMBLY

PRIORITY

This application claims the benefit of and priority to U.S. Provisional Application, entitled "Variable Angle Clamping Assembly," filed on Sep. 17, 2020 and having application Ser. No. 63/079,878, the entirety of said application being incorporated herein by reference.

FIELD

Embodiments of the present disclosure generally relate to a clamping assembly. More specifically, embodiments of the disclosure relate to an apparatus and methods for a variable angle and sliding clamp assembly.

BACKGROUND

Mechanical clamps are well known in the art. They have been utilized in a variety of industries from woodworking, mechanical and metal forming. Many different types of clamps exist, such as the well-known screw clamp that is often called a "C" clamp or a "G" Clamp. These screw clamps are widely utilized and very versatile. These types of clamps can be utilized to clamp a workpiece or to clamp workpieces together. The jaw openings of these types of clamps can be variable from very small to extremely large to accommodate different surfaces.

These types of clamps names originate from their similarity to the shapes of the letters C and G along with many other types of clamps. Typically, these angle clamps include a pair of jaws attached to the body, the jaws being spaced apart and oriented to face one another (opposing jaws). This can easily be illustrated by looking at a C clamp whereby at least one jaw is attached to one end of the "C" and a second end jaw is opposed to the first end jaw in alignment so as to allow one end to come in close proximity to the second end jaw and fixate a workpiece therebetween.

Other types of clamps include hand screw clamps, sash clamps, pipe clamps, bench clamps and the like. Similar to the C and G clamps, the "F" clamp has jaws being fixed on the top and the second arm extending away from the handle of the F that oppose each other. The jaw located on the second arm usually is able to slide along the second arm to allow for separation of the jaws to be quickly adjusted and utilized effectively.

A quick action clamp is a one-handed operated clamp that allows for easy clamping by utilizing a trigger on one end of the assembly. These types of clamps are also associated with quick release clamps that are also one-handed clamps designed with a mechanism that allows a user to release a workpiece in one quick movement. Similarly, the hand operated clamp may also allow the user to clamp a workpiece in one simple movement by using the trigger mechanism.

Other types of clamps include bar clamps which have a long metal bar that holds two parallel jaws. The extensive bar allows the user to clamp workpieces effectively. These types of clamps are used for heavy duty work and come in a variety of shapes and sizes including T bar clamps, pipe clamps, and the like.

Moreover, parallel clamps slide along a short rod and function similarly to a F clamp. They generally have a wide opening ability and are generally utilized for metal work, woodwork, and many other functions.

Generally, an angle clamp operates by changing the spacing between opposing jaws. In a C clamp, this is usually achieved by mounting the lower jaw on a threaded bolt which is engaged with the body of the clamp through a complementarily threaded aperture at the bottom end of the "C". Rotation of the bolt moves the lower jaw directly towards or away from the upper jaw. The arrangement of a threaded bolt having a jaw attached at one end may be referred to as a plunger.

In use, an object is placed between the jaws of a C clamp. The distance between the jaws is shortened until the jaws are in contact with the object, thus attaching it to the object. Further movement of the jaws applies pressure to the object. The object is released by reversing the procedure.

Angle clamps generally require access to at least two opposing surfaces (i.e., two substantially parallel planar surfaces) in order to engage the clamp and to apply a compressive force on a workpiece between the jaws of the clamp.

A limitation of such clamps is that opposing surfaces are frequently not available. This may arise if the shape of the piece is such that there are no opposing surfaces, or the opposing surfaces are separated by a distance too large for the clamp to span. In other situations, access to opposing surfaces may not be possible due to an obstruction.

This may be illustrated by consideration of a common example, such as connecting together two panels at right angles (to form an L or T shaped join for example). A C angle clamp or an F angle clamp may be used to hold the panels together at the join, provided the clamp can span the width of the panel. It will be readily appreciated by those skilled in the art that the width of the panels may frequently be such that it becomes impractical to use a C or F clamp. For example, the size of the clamp required to span a large panel may make it unwieldy or require more than one person to operate.

Angle clamps such as described above are limited to use with opposing surfaces because of their inability to grip onto surfaces that are not substantially parallel. It is an object of the present invention to address the foregoing problems and provide advantages over the prior art that will become apparent to those skilled in the art upon reading the description provided herein.

SUMMARY

An apparatus and methods are provided herein for a variable angle clamp assembly. The variable angle clamp assembly comprises a first support arm that may be pivoted relative to a second support arm. A coupling mechanism enables fixating an angle between the first and second support arms. A clamp assembly is mounted onto an elongate opening disposed along each of the first and second support arms. Each clamp assembly includes a fixed jaw and a movable jaw that may be tightened by way of a threaded screw and a handle. The clamp assemblies are slidable and rotatable along the elongate openings. A lock stop enables the clamp assembly to be fixated relative to each of the first and second support arms. The clamping assemblies may be manipulated into a variety of angles and radial distances along the support arms to provide a variety of clamping solutions.

In an exemplary embodiment, a variable angle clamp assembly comprises: a first support arm and a second support arm; a union disposed between the first support arm and the second support arm that allow for pivoting of the first support arm relative to the second support arm; and a first clamp assembly and a second clamp assembly.

In another exemplary embodiment, the union comprises a coupling mechanism configured to fixate an angle between the first support arm and the second support arm. In another exemplary embodiment, the first support arm and the second support arm each has an elongate opening located thereon. In another exemplary embodiment, the first support arm and the second support arm are made of a suitable rigid material including any of plastic, metal, alloy, or wood. In another exemplary embodiment, one or more of the first clamp assembly and the second clamp assembly includes at least a first fixed jaw and a movable jaw.

In another exemplary embodiment, one or more of the first clamp assembly and the second clamp assembly includes a fixed jaw and a movable jaw and also includes at least a threaded screw and handle affixed to the movable jaw. In another exemplary embodiment, the first clamp assembly and the second clamp assembly are movable within the elongate opening allowing them to slide fore and aft along the elongate opening from an innermost location to an extended location of the elongate opening. In another exemplary embodiment, the first clamp assembly and the second clamp assembly each includes an extended protrusion that extends through the elongate opening and a lock stop that facilitates fixating a position of the first clamp assembly and the second clamp assembly with the elongate opening. In another exemplary embodiment, the first clamp assembly and the second clamp assembly are rotatable with respect to the elongate opening. In another exemplary embodiment, the extended protrusion and the lock stop facilitates rotating the first clamp assembly relative to the first support arm; and wherein the extended protrusion and the lock stop facilitates rotating the second clamp assembly relative to the second support arm.

In an exemplary embodiment, a method for clamping a first member and a second member comprises: identifying an angle between the first member and the second member; pivoting a first support arm relative to a second support arm; moving a first clamp assembly along the first support arm to align with the first member; tightening the first clamp assembly onto the first member; moving a second clamp assembly along the second support arm into alignment with the second member; and tightening the second clamp assembly onto the second member.

In another exemplary embodiment, pivoting includes identifying the angle by way of a graduated index disposed on at least one of the first member and the second member. In another exemplary embodiment, pivoting includes fixating the angle between the first member and the second member by way of a coupling mechanism. In another exemplary embodiment, moving the first clamp assembly includes rotating the first clamp assembly relative to the first support arm. In another exemplary embodiment, moving the second clamp assembly includes rotating the second clamp assembly relative to the second support arm.

In another exemplary embodiment, tightening includes tightening a lock stop that is coupled with an extended protrusion that extends through an elongate opening in each of the first support arm and the second support arm. In another exemplary embodiment, moving includes sliding the extended protrusion fore and aft along the elongate opening in each of the first support arm and the second support arm. In another exemplary embodiment, tightening the lock stop includes causing the lock stop to press against a bottom surface of each of the first support arm and the second support arm.

These and other features of the concepts provided herein may be better understood with reference to the drawings, description, and appended claims.

BRIEF DESCRIPTION OF THE DRAWINGS

The drawings refer to embodiments of the present disclosure in which.

Figure 1:
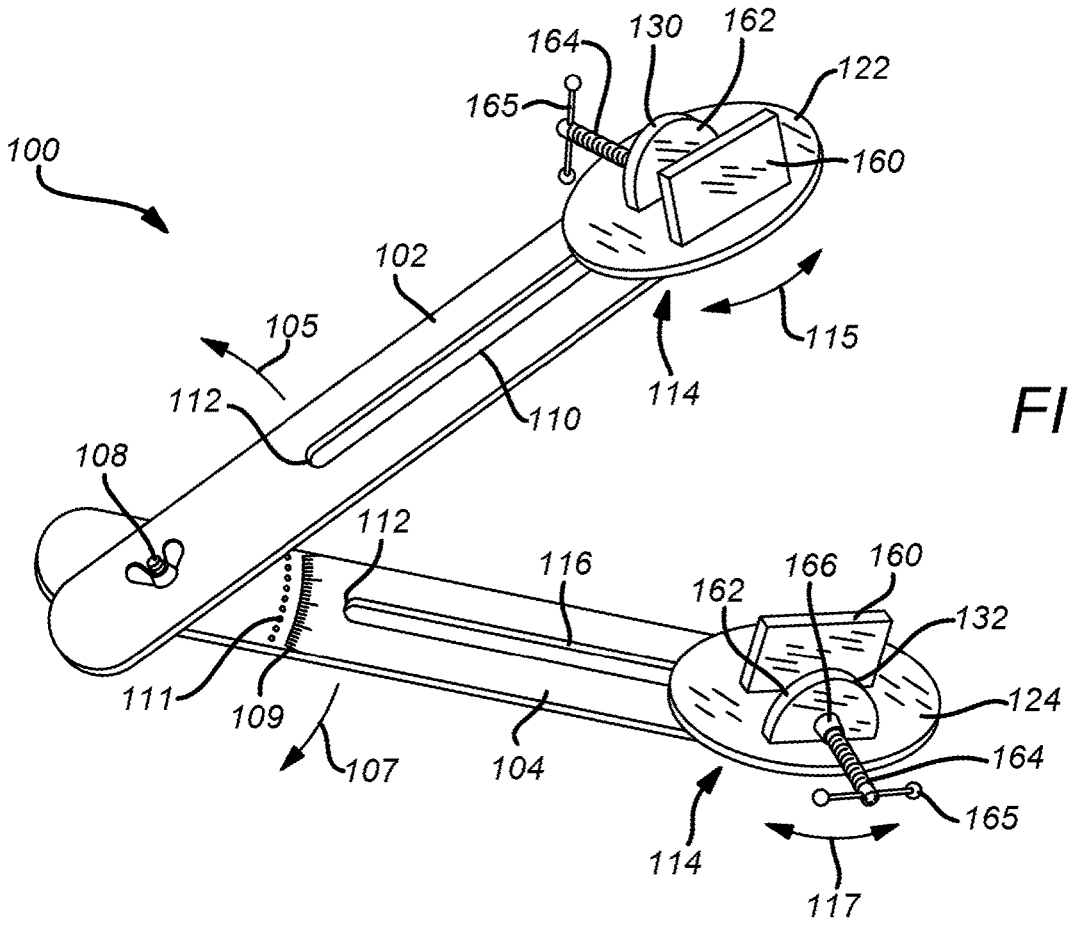
FIG. 1 illustrates a perspective view of an exemplary embodiment of a variable angle clamp, according to the present disclosure.

While the present disclosure is subject to various modifications and alternative forms, specific embodiments thereof have been shown by way of example in the drawings and will herein be described in detail. The invention should be understood to not be limited to the particular forms disclosed, but on the contrary, the intention is to cover all modifications, equivalents, and alternatives falling within the spirit and scope of the present disclosure.

DETAILED DESCRIPTION

In the following description, numerous specific details are set forth in order to provide a thorough understanding of the present disclosure. It will be apparent, however, to one of ordinary skill in the art that the invention disclosed herein may be practiced without these specific details. In other instances, specific numeric references such as "first rigid support," may be made. However, the specific numeric reference should not be interpreted as a literal sequential order but rather interpreted that the "first rigid support" is different than a "second rigid support." Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

Although different types of clamps are popular and are extremely versatile, they are not without disadvantages. For example, a "C" clamp is very useful for specific applications such as for clamping and combining a device or product having very planar surfaces such as wood or metal and the like. However, a problem that exists is that a C clamp is not as effective when surfaces are not planar or the products to be detained by the clamp are of unusual sizes and/or shapes. Because of the rigid nature of the clamp, the products that can be utilized or used with the clamp is very limited. Provided herein, in some embodiments, is a variable sizing and angled clamp that make utilization of the clamp easier for use with multiple surfaces and sized objects during use.

In general, the present disclosure describes a variable angle clamp assembly that is configured to be adjustable about X-Y axes and to be movable about the support arms and rotatable about same. The variable angle clamp assembly may include a plurality of adjustable arms and may be constructed in a variety of materials and sizes depending on need and utilization.

FIG. 1 illustrates an exemplary embodiment of a variable angle clamp 100 that is configured to provide a variety of clamping configurations in accordance with the present disclosure. The variable angle clamp 100 may comprise at least a first support arm 102 and a second support arm 104. The first support arm 102 and the second support arm 104 may be coupled via a coupling mechanism 108. The coupling mechanism 108 may include any of a screw, a wingnut, a rivet, or any other type of fastener that may allow for coupling of the first support arm 102 to the second support arm 104. It should be understood that the first support arm 102 and the second support arm 104 may be comprised of any suitable material including hard plastics, metals or metal alloys, wood, or any other rigid material.

Moreover, it should be understood that the coupling mechanism 108 not only allows for coupling of the first support arm 102 and the second support arm 104, but also allows for pivoting and rotating of the first support arm 102 and the second support arm 104 relative to each other along directions 105 and 107. Thus, the first support arm 102 may rotate away from the second support arm 104 allowing for increasing the space between the arms and thereby allowing for variability in the angle and distance of clamp utilization on a particular object (not shown). The angle between the first and second support arms 102, 104 may be indicated by way of a graduated index 109 printed or inscribed onto the second support arm 104. Further, either of the first and second support arms 102, 104 may include a series of bumps 111 or other embossed shapes suitable for fixating the angle between the first and second support arms 102, 104 when the coupling mechanism 108 is tightened.

FIG. 1 also illustrates a first elongate opening 110 on the first support arm 102, extending from a first end 112 of the first elongate opening 110 to a second end 114 of the first elongate opening 110. Similarly, the second support arm 104 also has an elongate opening 116 extending from a first end 112 to a second end 114 of the elongate opening 116 on the second support arm 104. These elongate openings 110, 116 allow for maneuvering clamps 122, 124 respectively along the lengths of the first and second support arms 102, 104. As such, the clamps 122, 124 may be moved from a more inward orientation to and extended orientation relative to the first support arm 102 and the second support arm 104.

As disclosed hereinbelow, the variable angle clamp 100 preferably includes at least two support arms 102, 104 but may include additional arms as desired. Moreover, the support arms 102, 104 also have attached thereto at least a first clamping mechanism 130 and a second clamping mechanism 132 that are respectively located on the first support arm 102 and the second support arm 104. In some embodiments, the first clamping mechanism 130 and the second clamping mechanism 132 are attached to the first support arm 102 and the second support arm 104 by way of an extended protrusion 134 located on an underside 136 of each clamping mechanism 130, 132. The extended protrusion 134 extends away from the clamping mechanism 130, 132 and through the first elongate opening 110 and similarly through the second elongate opening 116. The extended protrusion 134 may be a simple length of metal, a screw, or any other type of protrusion extending away from the clamping mechanism 130, 132 and through the first or second elongate openings 110, 116.

Figure 2:
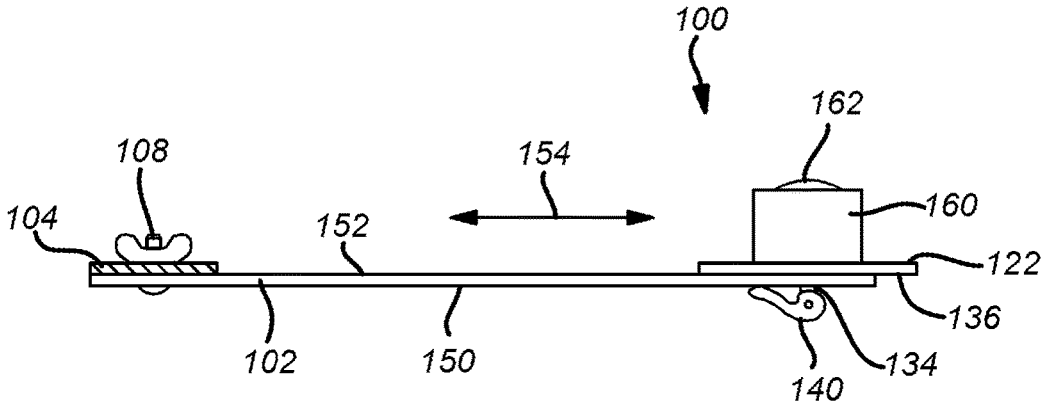
FIG. 2 illustrates a side plan view of a variable angle clamp in an embodiment of the present invention.

In an embodiment illustrated in FIG. 2, looking specifically at the first clamping mechanism 130, the clamping mechanism 130 having an extended protrusion 134 whereby the extended protrusion 134 also has a lock stop 140. The lock stop 140 is located away from the clamping mechanism 130 and ideally is located on a lower side 150 of the first support arm 102. An upper side 152 of the first support arm 102 accommodates the clamping mechanism 130. The utilization of the lock stop 140 allows for movement of the clamping mechanism 130 along the elongate opening 110, as indicated by direction 154. Further, the lock stop 140 and the extended protrusion 134 facilitates rotating the clamping mechanism 130 with respect to the first support arm 102, along direction 115, as shown in FIG. 1. Similarly, the clamping mechanism 132 may be rotated with respect to the second support arm 104, along direction 117, by using an extended protrusion 134 and a lock stop 140 that attach the clamping mechanism 132 to the second support arm 104.

As shown in FIG. 1, each of the clamping mechanisms 130, 132 has at least a fixed jaw 160 and a slidable jaw 162. The slidable jaw 162 having at least a screw 164 which causes the slidable jaw 162 to move relative to the fixed jaw 160. The slideable jaw 162 also includes a handle 165 and a collar 166. The handle 165 extends away from the screw 164 allowing for easier utilization by the end user. When the handle 165 is utilized by the user, the screw 164 which is threaded may enable the slideable jaw 162 to move into a location that is either closer to the fixed jaw 160 or extend further away from the fixed jaw 160 depending on the desires of the user and the need to allow for the clamp 100 to be utilized with a particular project by the user.

It should be noted that the clamping mechanisms 130, 132 may each have their own slideable jaw 162 and fixed jaw 160 (see FIG. 1) that act separately and distinct from one another. As such, each clamping mechanism 130, 132 may be utilized independently from each other or in combination as desired by the user. For example, it is contemplated that the clamping mechanisms 130, 132 may be utilized in cornering clamping applications whereby more than one clamp assembly is needed to clamp a corner piece of furniture together.

Figure 3:
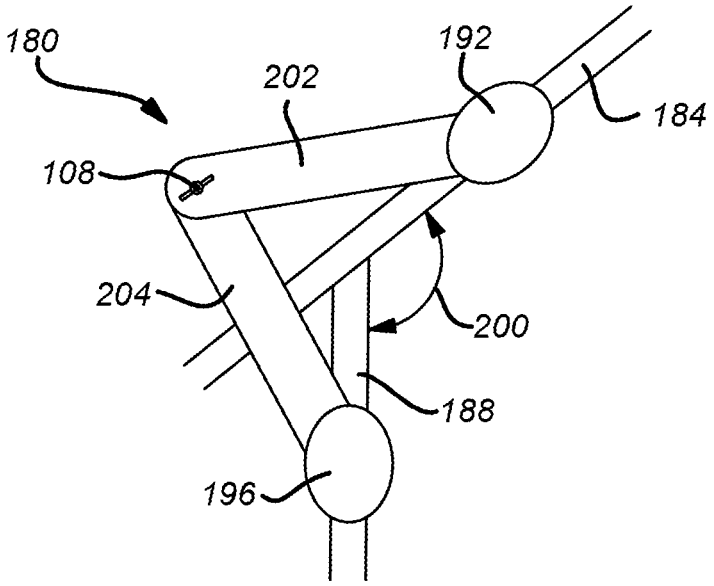
FIG. 3 illustrates an exemplary-use environment wherein a variable angle clamps is securing two beams in accordance with the present disclosure.

FIG. 3 illustrates an exemplary-use environment wherein a variable angle clamp 180 is securing a first beam 184 and a second beam 188 in accordance with the present disclosure. As shown in FIG. 3, a first clamping mechanism 192 of the variable angle clamp 180 is attached to the first beam 184 while a second clamping mechanism 196 is attached to the second beam 188. A desired angle 200 between the first and second beams 184, 188 is maintained upon fixating first and second support arms 202, 204 of the variable angle clamp 180. As will be appreciated, the first and second support arms 202, 204 may be fixated by way of tightening a coupling mechanism 108 as described hereinabove with respect to FIG. 1.

Figure 4:
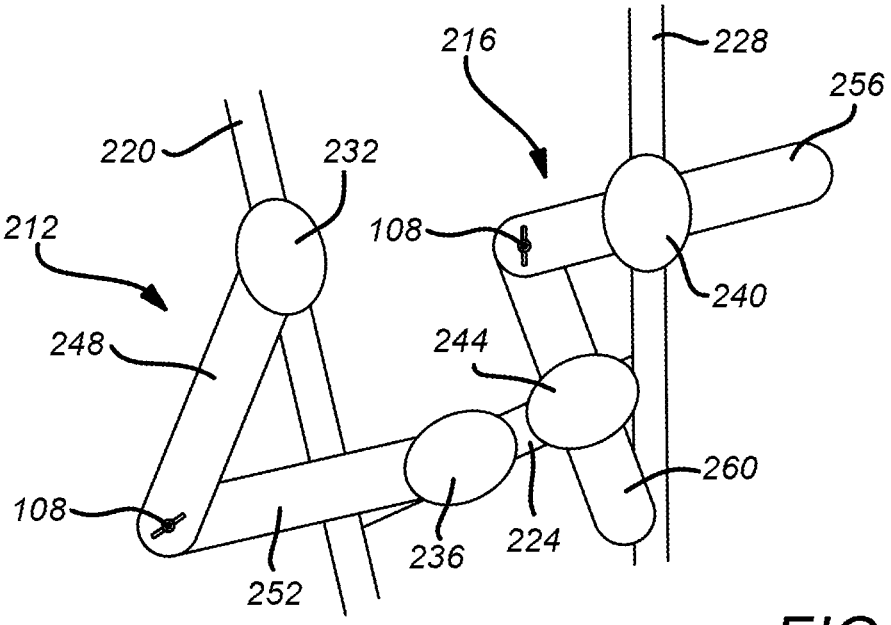
FIG. 4 illustrates an exemplary-use environment wherein two variable angle clamps are cooperating to secure three beams, according to the present disclosure.

FIG. 4 illustrates an exemplary-use environment wherein a first variable angle clamp 212 and a second variable angle clamp 216 are being used in cooperation to secure a first beam 220, a second beam 224, and a third 228 beam, according to the present disclosure. As shown in FIG. 4, the first variable angle clamp 212 comprises a first clamping mechanism 232 and a second clamping mechanism 236 that are respectively attached to the first beam 220 and the second beam 224 while the second variable angle clamp 216 includes a first clamping mechanism 240 and a second clamping mechanism 244 that are respectively attached to the third beam 228 and the second beam 224. As will be recognized, tightening a coupling mechanism 108 comprising the first variable angle clamp 212 causes first and second support arms 248, 252 of the clamp 212 to maintain a desired angle between the first and second beams 220, 224. Further, a coupling mechanism 108 comprising the second variable angle clamp 216 may be tightened to fixate a first support arm 256 and a second support arm 260 of the clamp 216 and thus maintain a desired angle between second beam 224 and the third beam 228.

It should be recognized that the variable angle clamp described herein is not limited to angular adjustments of the first and second support arms, but rather the clamping mechanisms comprising the variable angle clamp may be moved along the length of the first and second support arms to provide variety of radial adjustments. For example, as shown in FIG. 4, the first clamping mechanism 240 of the second variable angle clamp 216 has been positioned near a midpoint of the first support arm 256 to engage with the third beam 228, and the second clamping mechanism 244 has been similarly positioned along the length of the second support arm 260 to engage with the second beam 224. It should be understood, therefore, that the variable angle clamp enables the clamping mechanisms to be manipulated into a variety of angles and radial distances along the support arms, thereby providing a plurality of clamping solutions, without limitation.

While the invention has been described in terms of particular variations and illustrative figures, those of ordinary skill in the art will recognize that the invention is not limited to the variations or figures described. In addition, where methods and steps described above indicate certain events occurring in certain order, those of ordinary skill in the art will recognize that the ordering of certain steps may be modified and that such modifications are in accordance with the variations of the invention. Additionally, certain of the steps may be performed concurrently in a parallel process when possible, as well as performed sequentially as described above. To the extent there are variations of the invention, which are within the spirit of the disclosure or equivalent to the inventions found in the claims, it is the intent that this patent will cover those variations as well. Therefore, the present disclosure is to be understood as not limited by the specific embodiments described herein, but only by scope of the appended claims.

What is claimed is:

1. A variable angle clamp assembly, comprising:

a first support arm and a second support arm;

a union disposed between the first support arm and the second support arm that allow for pivoting of the first support arm relative to the second support arm; and a first clamp assembly and a second clamp assembly;

wherein the first clamp assembly and the second clamp assembly are movable within the elongate opening allowing them to slide fore and aft along the elongate opening from an innermost location to an extended location of the elongate opening; and wherein one or more of the first clamp assembly and the second clamp assembly includes a fixed jaw and a movable jaw and a threaded screw and handle affixed to the movable jaw.

2. The variable angle clamp of claim 1, wherein the union comprises a coupling mechanism configured to fixate an angle between the first support arm and the second support arm.

3. The variable angle clamp of claim 1, wherein the first support arm and the second support arm each has an elongate opening located thereon.

4. The variable angle clamp of claim 1, wherein the first support arm and the second support arm are made of a suitable rigid material including any of plastic, metal, alloy, or wood.

5. The variable angle clamp of claim 1, wherein one or more of the first clamp assembly and the second clamp assembly includes at least a first fixed jaw and a movable jaw.

6. The variable angle clamp of claim 1, wherein the first clamp assembly and the second clamp assembly each includes an extended protrusion that extends through the elongate opening and a lock stop that facilitates fixating a position of the first clamp assembly and the second clamp assembly with the elongate opening.

7. The variable angle clamp of claim 6, wherein the first clamp assembly and the second clamp assembly are rotatable with respect to the elongate opening.

8. The variable angle clamp of claim 6, wherein the extended protrusion and the lock stop facilitates rotating the first clamp assembly relative to the first support arm; and wherein the extended protrusion and the lock stop facilitates rotating the second clamp assembly relative to the second support arm.

9. A method for clamping a first member and a second member, comprising:

identifying an angle between the first member and the second member;

pivoting a first support arm relative to a second support arm;

moving a first clamp assembly along the first support arm to align with the first member;

tightening the first clamp assembly onto the first member;

moving a second clamp assembly along the second support arm into alignment with the second member;

tightening the second clamp assembly onto the second member;

wherein tightening includes tightening a lock stop that is coupled with an extended protrusion that extends through an elongate opening in each of the first support arm and the second support arm;

wherein tightening the lock stop includes causing the lock stop to press against a bottom surface of each of the first support arm and the second support arm; and wherein moving includes sliding the extended protrusion fore and aft along the elongate opening in each of the first support arm and the second support arm.

10. The method of claim 9, wherein pivoting includes identifying the angle by way of a graduated index disposed on at least one of the first member and the second member.

11. The method of claim 9, wherein pivoting includes fixating the angle between the first member and the second member by way of a coupling mechanism.

12. The method of claim 9, wherein moving the first clamp assembly includes rotating the first clamp assembly relative to the first support arm.

13. The method of claim 9, wherein moving the second clamp assembly includes rotating the second clamp assembly relative to the second support arm.

* * * * *